United States Patent [19]

Spiegel

[11] Patent Number: 4,657,252

[45] Date of Patent: Apr. 14, 1987

[54] COMBINATION FOOTBALL PLACE KICKING TEE AND PLACE KICKING BLOCK

[76] Inventor: H. Jay Spiegel, 2112 Whiteoaks Dr., Alexandria, Va. 22306

[21] Appl. No.: 726,765

[22] Filed: Apr. 24, 1985

[51] Int. Cl.[4] ..... A63B 67/00

[52] U.S. Cl. ..... 273/55 B

[58] Field of Search ..... 273/55 B, 202, 203, 273/212; D21/208, 209; D7/1, 27

[56] References Cited

U.S. PATENT DOCUMENTS

| | | | |
|---|---|---|---|
| 99,827 | 5/1836 | Scaman | D7/1 |
| 176,252 | 12/1855 | Duncan | D7/27 |
| 231,003 | 3/1874 | Ponder | D21/209 |
| 232,203 | 7/1874 | Montgomery | D7/27 |
| 266,015 | 8/1882 | Patton | D21/209 |
| 876,808 | 1/1908 | Kinert | D7/27 |
| 1,544,972 | 7/1925 | Gebelein | D7/27 |
| 2,294,657 | 9/1942 | Flanagan | D7/27 |
| 2,352,684 | 7/1944 | Braddock | D7/27 |
| 2,659,604 | 11/1953 | McGowen | 273/55 B |
| 3,309,087 | 3/1969 | Cullity | 273/55 B |
| 3,481,602 | 12/1969 | Tatter | 273/55 B |
| 4,019,735 | 4/1977 | Thompson | 273/55 B |
| 4,049,267 | 9/1977 | Forrest | 273/55 B |
| 4,537,397 | 8/1985 | Kopp | 273/55 B |

FOREIGN PATENT DOCUMENTS

| | | | |
|---|---|---|---|
| 1253019 | 12/1960 | France | D7/1 |

*Primary Examiner*—Richard C. Pinkham
*Assistant Examiner*—T. Brown
*Attorney, Agent, or Firm*—H. Jay Spiegel

[57] ABSTRACT

An improved kicking tee is usable in one orientation as a place kicking tee and in another orientation thereof as a kicking block. When used as a kicking tee, the ball is supported within a recess having a configuration conforming to the shape of the end of an oblate spheroidal football. This recess cooperates with a pair of opposed ribs which urge the football through frictional forces into firm engagement with the recess. Adjacent the ribs, a relieved area is provided which enables the tip of the football to be kicked from the recess and from the tee without resistance. When the disclosed tees are flipped over a generally flat surface with small projections extending outwardly therefrom faces upwardly and may be used as a surface on which the ball may be held such that the tee is usable as a kicking block. In at least one embodiment of the present invention, behind the recess, an angled surface is formed. The tee is designed such that the recess is provided closely adjacent the rearwardmost surfaces of the tee. The present invention is usable with equal success by kickers who utilize all kicking styles including the conventional straight-on technique and the "soccer-style" technique.

24 Claims, 16 Drawing Figures

Fig. 3
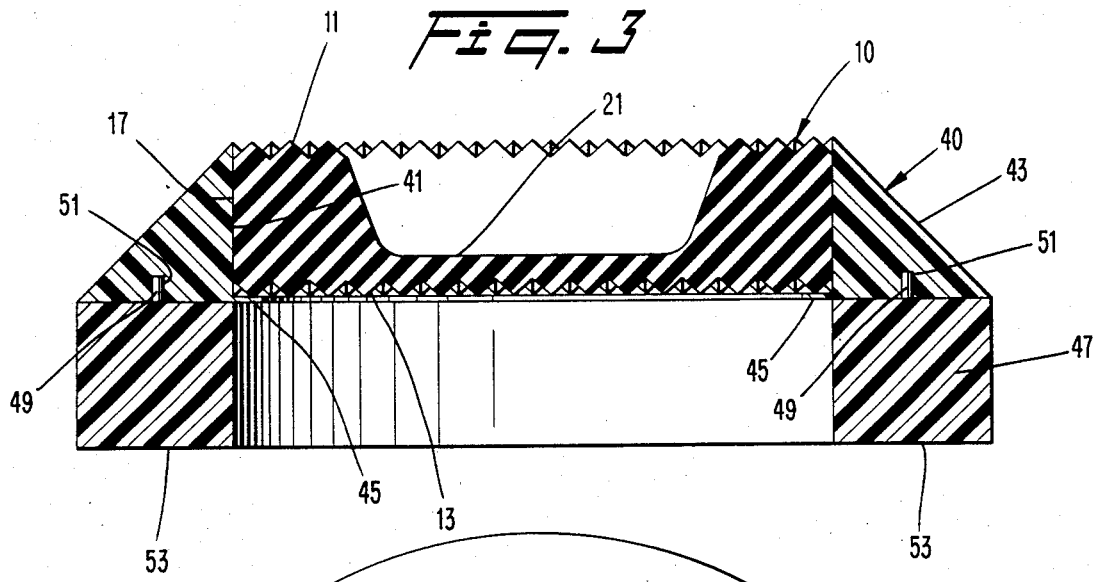
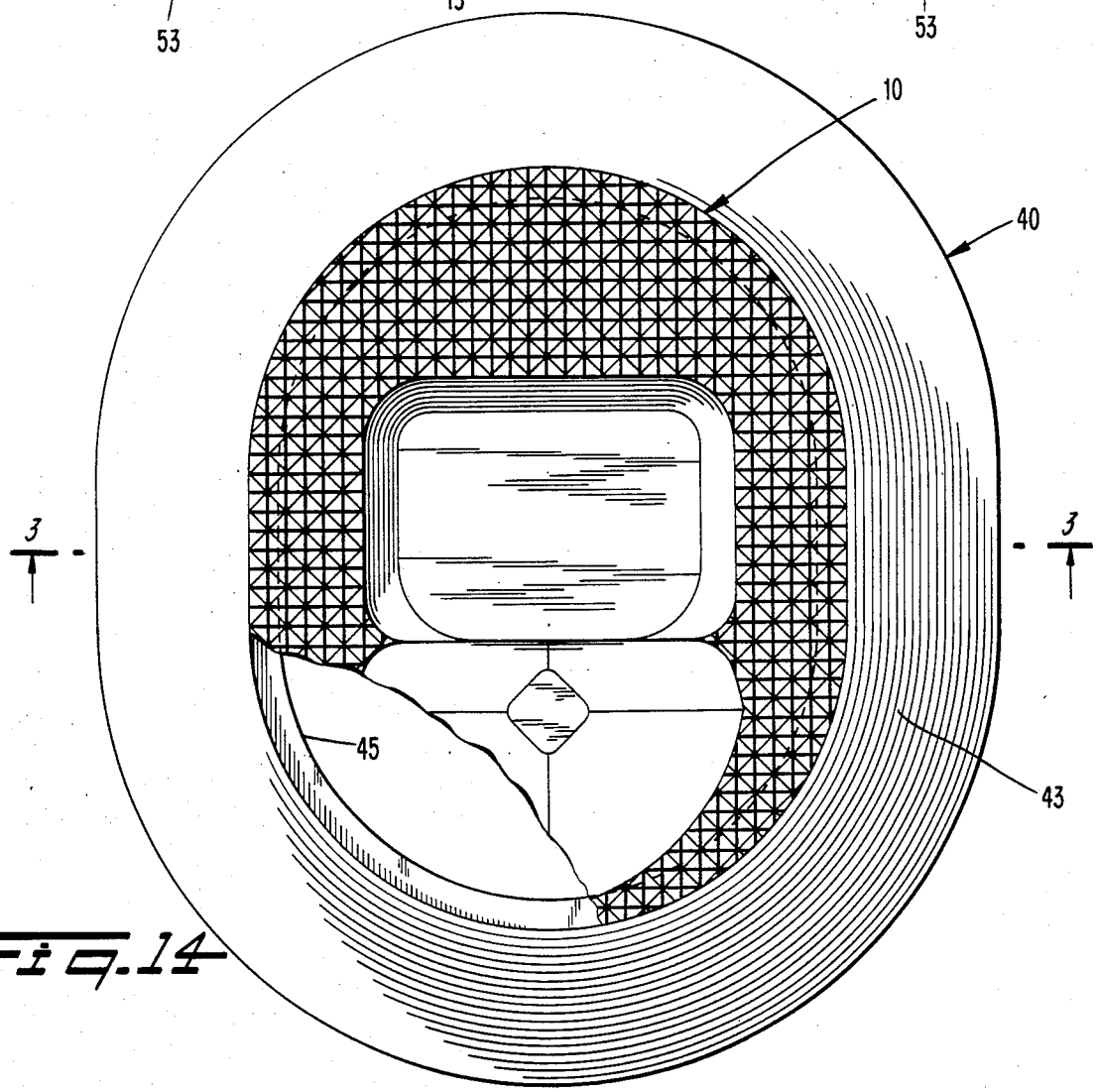
Fig. 14

Fig. 11
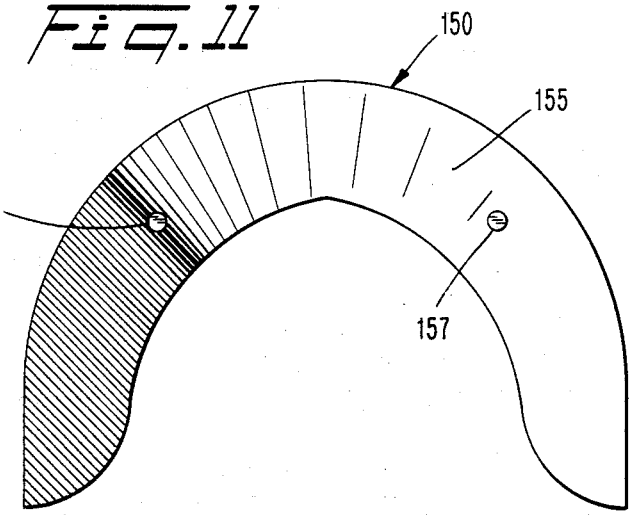
Fig. 12
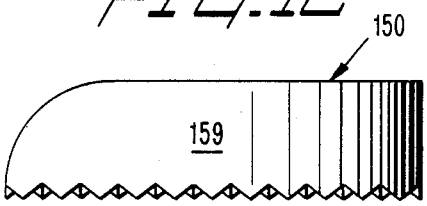
Fig. 13
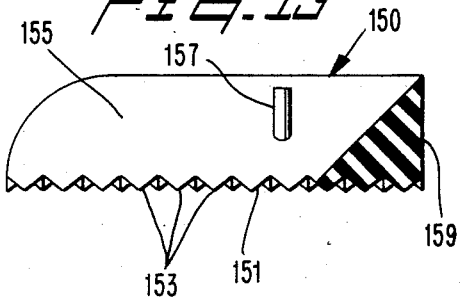
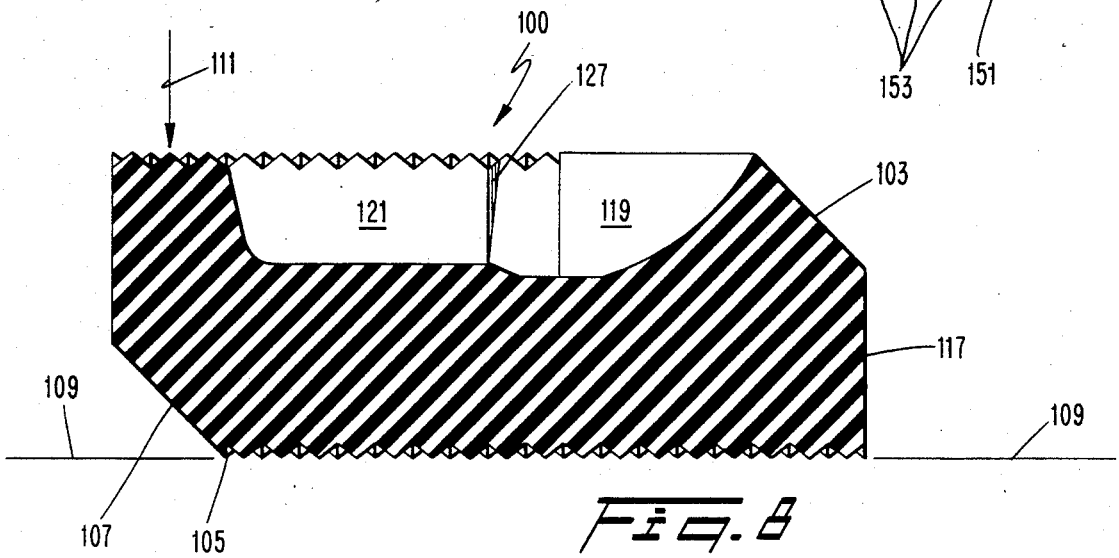
Fig. 8
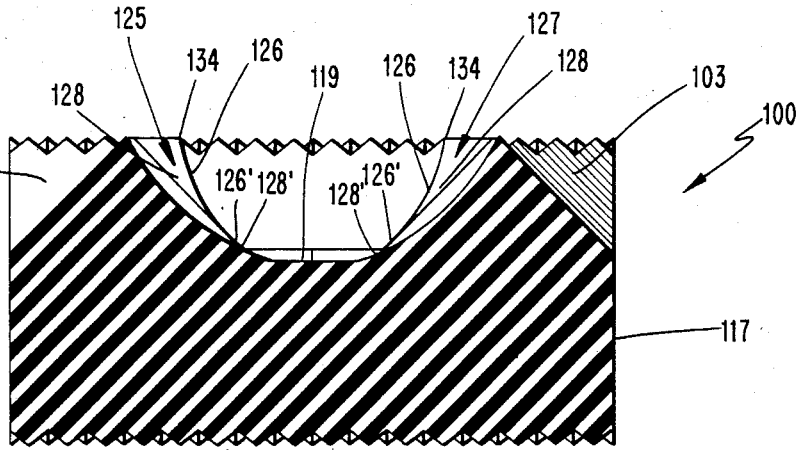
Fig. 9

COMBINATION FOOTBALL PLACE KICKING TEE AND PLACE KICKING BLOCK

BACKGROUND OF THE INVENTION

The present invention relates to a combination football place kicking tee and place kicking block. Each of the embodiments disclosed herein comprise improvements over the teachings of co-pending U.S. patent application Ser. No. 629,429 filed July 10, 1984, with the inventor herein being a co-inventor of the invention disclosed in the above referenced United States patent application. In particular, the embodiments of the present invention are believed to be improvements over the embodiment illustrated in FIGS. 20–22 of the above referenced U.S. patent applicaiton. Accordingly, the above referenced U.S. patent application is incorporated by reference herein including the discussion in the background of the invention thereof of certain prior art references.

After the development of the kicking tee depicted in FIGS. 20–22 of pending U.S. patent application Ser. No. 629,429, extensive tests were conducted so as to ascertain the effectiveness of the tee illustrated therein in the kicking tee mode for various angles of the ball as placed in the recesses 407 thereof, and the tee was further analyzed in the kicking tee mode to ascertain its effectiveness for kickers of differing styles.

During the course of the study of the tee illustrated in FIGS. 20–22 of the above referenced pending U.S. patent application, the following deficiencies were discovered to be present in the operation thereof:

(1) It was discovered that the recess 407 thereof was suitable for supporting the football in a vertical orientation but was not as effective in supporting the ball at slight tilts from vertical as is sometimes a preferred orientation of the ball for kickers of all different styles.

(2) It was further discovered that the tee with the ball inserted into the recess thereof substantially vertically was suitable for use with conventional straight-on style kickers, however, it was also discovered that some soccer-style kickers were not having the same positive results as straight-on kickers.

(3) Careful study revealed that when soccer-style kickers swing their kicking foot through the ball, before impact with the ball, the end of their kicking foot comes very close to engaging the ground surface and usually pivots through the existing grass on natural turf surfaces. Thus, soccer-style kickers had a tendency to kick the corners of the tee in both the kicking tee and kicking block modes, thereby disrupting the fluid nature of the intended kick.

(4) It was further discovered by Applicant that with the recess 407 situated as shown in FIG. 20 of the above referenced United States patent application, soccer-style kickers could not engage the ball with their kicking foot at the most optimal location thereon. It was discovered through careful study that while straight-on kickers kicked the ball at an elevation from the bottom tip thereof of at least three inches, soccer-style kickers engaged the ball in a manner such that the end of their shoe or foot may come within $1\frac{1}{2}$ inches of the bottom tip of the ball. With the tee as designed in FIGS. 20–22 of the above referenced U.S. patent application, soccer-style kickers found it difficult to kick the ball in the optimal location thereon.

(5) It was further discovered that soccer-style kickers in many cases had a psychological problem with kicking the football off a tee which had a sharp corner facing their foot as their foot arced toward the ball.

Again, while the tee shown in FIGS. 20–22 of the above referenced U.S. patent application provided many advantages for use with conventional straight-on style kickers, it was not as effective a tee for soccer-style kickers. Since most kickers at the present time utilize the soccer-style technique, it was apparent that a new tee would have to be devised so as to overcome the deficiencies found in the prior art tee as exemplified by FIGS. 20–22 of the above referenced United States patent application. A tee would have to be devised which would be equally effective with soccer-style kickers as well as conventional straight-on style kickers and such a tee would have to allow the ball to be tilted at greater angles than the prior art tee.

SUMMARY OF THE INVENTION

Thus, in order to further advance the state of the art and to provide further advantages over prior art tees as explained hereinabove, the present invention in a plurality of embodiments, has been devised. The present invention includes the following new features which constitute improvements over the prior art designs:

(1) In a first aspect of the present invention, each embodiment thereof is comprised of a kicking tee having peripheral surfaces which are curved at the front and back thereof in the precise areas where the kicker's foot will be swinging into the ball.

(2) In a first embodiment of the present invention, the ball-receiving recess is located immediately adjacent the curved outer peripheral surfaces of the tee so that soccer-style kickers will not hit the tee prior to striking the ball.

(3) In a further embodiment of the present invention, the back edges of the ball-receiving recess define the rearmost extent of that surface of the tee and therebehind, the tee body is sloped away from the recess, downwardly, to provide a substantially semi-circular ramp up to the ball for the kicker's foot.

(4) In a further aspect of this further embodiment, on the flip side of the tee, adjacent the surface which will be utilized as a kicking block, a sloped surface is provided therebehind of precisely the same configuration as the sloped surface adjacent the ball-receiving recess. In this vein, a removable piece is provided which is attachable to the tee so as to overlie either one of the sloping surfaces as desired. In this way, the removable piece may be inserted into the sloping surface which faces the ground so as to ensure stability of the tee with respect to the ground surface in any orientation thereof.

(5) In the first mentioned embodiment of the tee of the present invention, a removable skirt may be provided into which the inventive tee may be installed, which skirt provides a sloped surface around the entire periphery of the tee. The skirt may have a thickness equal to the thickness of the tee, or if desired, may be made of a thickness providing additional ball elevation when used in conjunction with the tee as will be explained in greater detail hereinafter.

(6) In a further aspect of the present invention which is included in all embodiments thereof, the opposed ribs which are formed adjacent the ball-receiving recess so as to facilitate the retention of the ball therein, are provided with symmetrical terminating edges which are curved where they interface with the bottom of the recess. These curved portions are provided so as to enable engagement with the tip of the football when the football is tilted away from the vertical so as to add to the stability of the ball in tilted orientations.

(7) In a further aspect of the present invention, the opposed ribs, described above, have been re-designed so as to protrude further into the recess and so that the terminating edges thereof are closer to one another. As a result, the ribs have a thinner profile than they possessed in the tee as disclosed in the prior U.S. patent application and thereby have increased flexibility. Thus, when an oblate spheroidal football is placed in the recess, the ribs flex outwardly toward the relieved portion and cradle the tip of the football while the resiliency thereof tends to move the football toward the back of the tee to thereby increase the holding power of the combination of the recess and the ribs.

(8) One of the more important aspects of the present invention, in each embodiment thereof, consists of the particular design whereby when a football is placed in the ball-receiving recess in any orientation thereof used by place kickers whether precisely vertical or slightly tilted in any backward or sideways orientation, substantially the entire surface of the football which is to be kicked is behind or to the side of all tee structure. As a result, the tees disclosed herein may be utilized by place kickers without fear that the tee will be kicked, since the ball is kicked prior to any possibility that the kicking foot will engage the tee.

(9) In a further related aspect of the present invention in each embodiment thereof, the tee is specifically designed for all styles of kicking so that with the ankle locked, with the foot perpendicular to the leg as is the case with straight-on kickers, or with the ankle locked with the foot substantially parallel to the leg, as is the case with soccer-style kickers, the arc of the foot during the kicking motion thereof will not intersect any tee structure. In this regard, the curved surfaces of the tee as will be described in greater detail hereinafter, remove any psychological problems which may have existed for certain kickers, using the prior art tee structure and completely remove any fear that the kicker may have of kicking the tee during the kicking motion.

Accordingly, it is a first object of the present invention to provide a place kicking tee which may be utilized both for kick-offs as well as for field goals and extra points.

It is a further object of the present invention to provide a kicking tee which will support a football in a tee mode whereby substantially the entire surface of the football which is to be kicked by the kicker is behind or to the side of all tee structure.

It is a yet further object of the present invention to provide a kicking tee designed in such a manner that the arc of the foot during the kicking motion will not intersect in any way with any tee structure.

It is a yet further object of the present invention to provide a kicking tee which will support the ball both vertically and at various angles of tilt from vertical with virtually the same ball retention.

It is a still further object of the present invention to provide a kicking tee having a flip side with projections thereon which flip side enables the ball to be held thereon by a holder whereby the place kicking tee comprises a kicking block.

It is a still further object of the present invention to provide a kicking tee which removes all psychological barriers to kicking such as the fear of kicking the tee during the kicking motion.

These and other objects, advantages and aspects of the present invention will become more readily apparent from the following detailed description of the preferred embodiments thereof when taken in conjunction with the accompanying drawing figures.

BRIEF DESCRIPTION OF THE DRAWINGS

FIG. 3 shows a cross-sectional view along the line 3—3 of FIG. 14.

FIG. 8 shows a cross-sectional view along the line 8—8 of FIG. 4.

FIG. 9 shows a cross-sectional view along the line 9—9 of FIG. 4.

FIG. 11 shows a bottom view of the appliance of FIG. 10.

FIG. 12 shows a side view of the appliance of FIG. 10.

FIG. 13 shows a further side view of the appliance of FIG. 10 from a different orientation from the view of FIG. 12.

FIG. 14 shows a top view of a further modification.

SPECIFIC DESCRIPTION OF THE PREFERRED EMBODIMENTS

Figure 1:
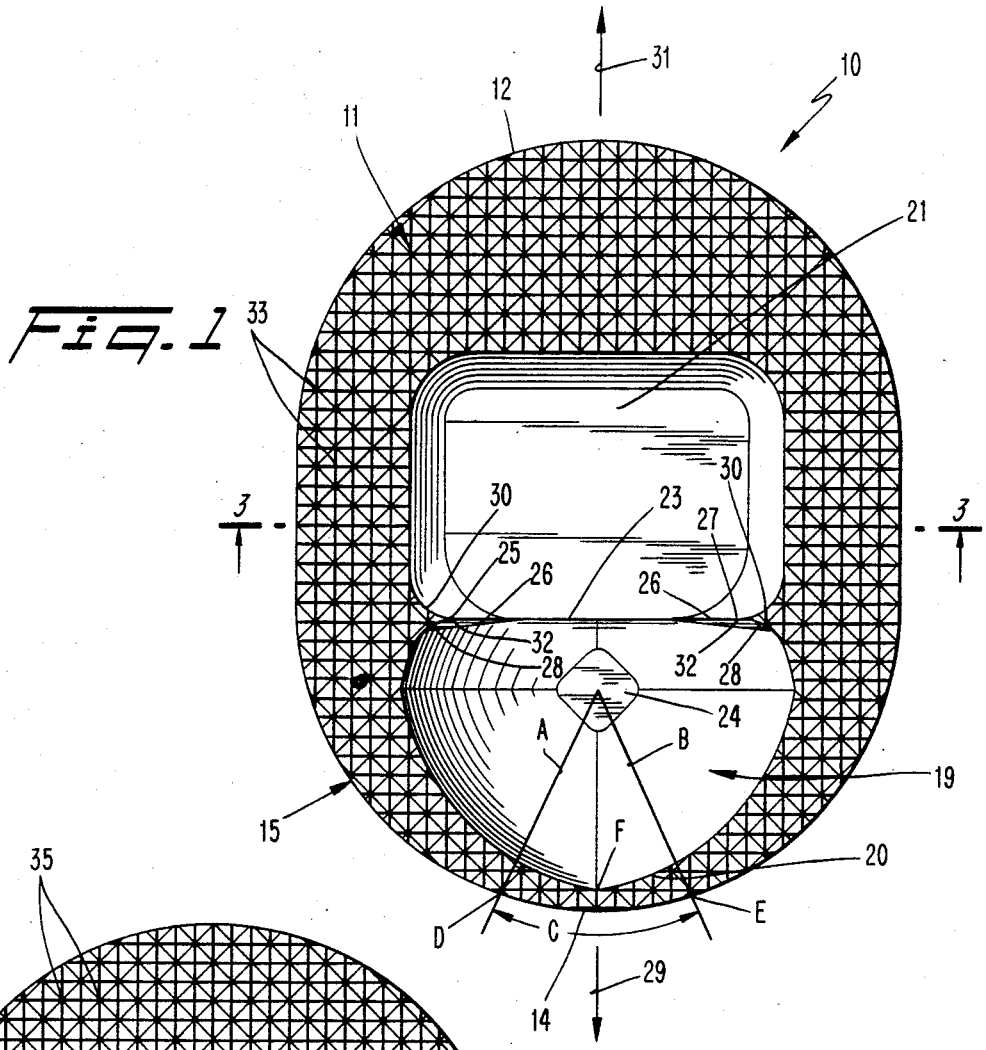
FIG. 1 shows a top view of a first embodiment of the present invention.
Figure 2:
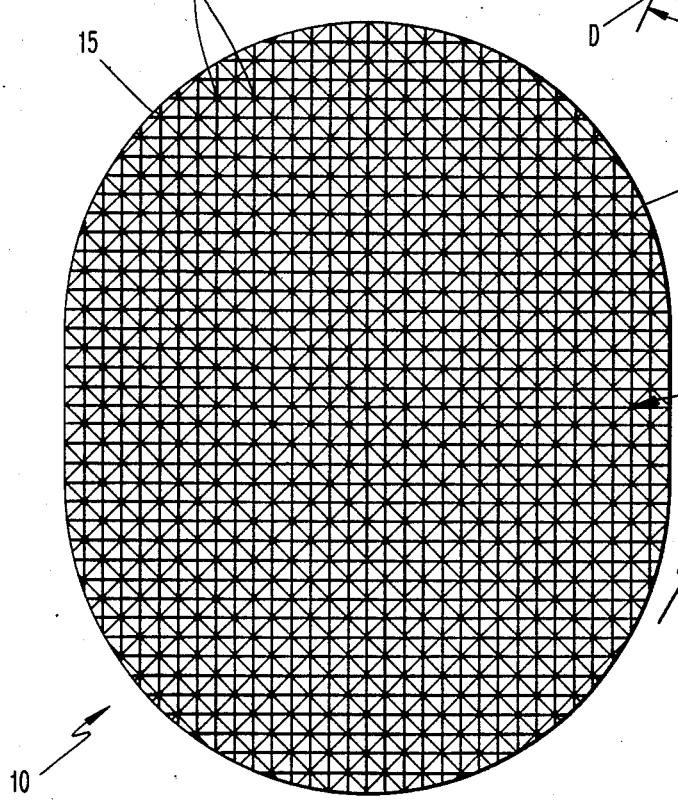
FIG. 2 shows a bottom view of the embodiment shown in FIG. 1.
Figure 15:
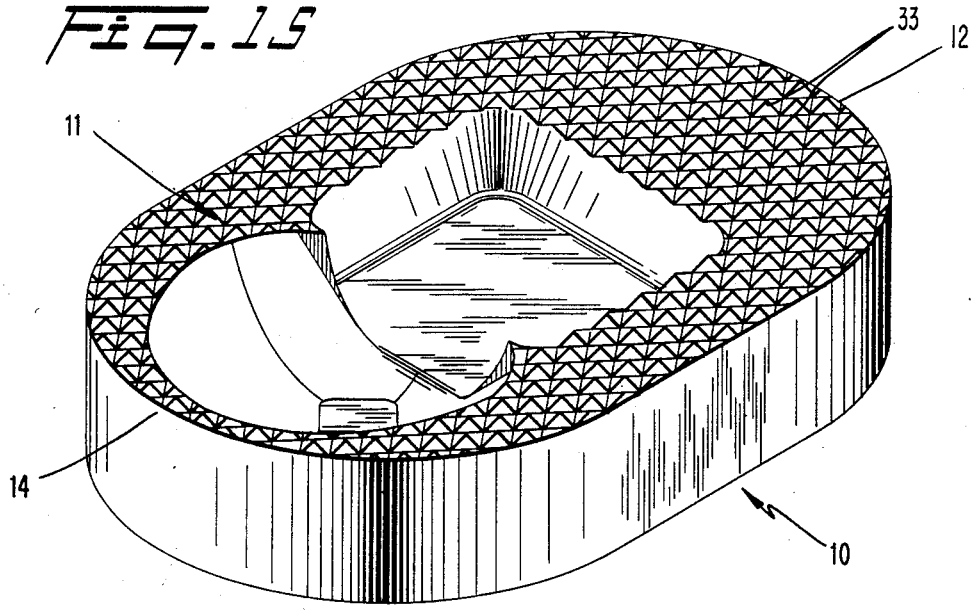
FIG. 15 shows a perspective view of the embodiment of FIGS. 1–2.

With reference first to FIGS. 1, 2 and 15, a first embodiment of the present invention will be described. Therein, a tee 10 is seen to include a top surface 11 (FIG. 1), a bottom surface 13 (FIG. 2), and an outer perimeter 15 (FIG. 15) having a front face 12 and a rear face 14 each defining a curved profile at their intersection with the respective top and bottom surfaces 11 and 13. In the cross-sectional view of FIG. 3, the outer perimeter is seen to be defined by a wall 17 approximately 1" in thickness. This is intended to merely be an example of one configuration of this embodiment, since the wall 17, may, if desired, be made of sufficient extent so as to support a ball on the tee at an elevation of 3" under current N.F.L. rules.

With reference back to FIG. 1, it is seen that the top surface 11 has extending inwardly therefrom a first recess 19 having a rear profile, 20, a second recess 21, and an area designated by the reference numeral 23 at which the recesses 19 and 21 intersect. The details of the recesses 19 and 21 and the interface 23 are identical for all embodiments of the tee as disclosed herein and these specific details will be better understood hereinafter from the specific description of FIGS. 8 and 9.

With reference to FIG. 1, it is seen that at the interface 23 between the recesses 19 and 21, a pair of opposed ribs 25 and 27 are provided. The ribs 25 and 27 are provided as will be explained hereinafter so as to urge the football when placed into the recess 19 toward the direction of the arrow 29 so as to ensure that the ball is snugly retained within the recess 19. The recess 21 is provided so that when the football is kicked in the direction of the arrow 31, the tip thereof will be able to leave the tee without interference therefrom. As further shown in FIG. 1, the top surface 11 is covered with a plurality of projections designated by the reference numeral 33 which extend over the entirety of the surface thereof so that when the tee is flipped over to comprise a kicking block, the projections 33 will engage the ground surface and aid in retaining the tee in a fixed position where placed by the kicker or holder.

In this regard, reference is now made to FIG. 2 which shows the tee depicted in FIG. 1 flipped over so that the bottom surface 13 is facing upwardly. As may be seen in FIG. 2, the perimeter 15 from the bottom of the tee 10 is substantially identical to the perimeter 15 when seen from the top of the tee 10. Thus, as seen in FIG. 3, the wall 17 is substantially perpendicular to the surfaces 11 and 13. The bottom surface 13 of the tee 10 is covered with a plurality of projections 35 substantially identical to the projections 33 shown in FIG. 1. The projections 35 are provided so that when the tee is used as a kicking block, a holder may place the tip of the ball on the surface 13 without fear that the ball will slip off the surface 13 even in wet game conditions.

With particular reference now to FIGS. 3 and 14, it is seen that the kicking tee 10 may be supported in a stand 40 having an inner wall 41 conforming to the outer walls 17 of the tee 10, and having an outer wall 43 which slopes from the top of the stand to the bottom thereof which sloped surface 43 may extend completely around the periphery of the stand 40 as best seen with reference to FIG. 14. The stand 40 may further include a horizontally extending lip 45 adapted to cradle the bottom of the tee 10 when it is inserted into the stand 40. Thus, with the tee 10 inserted into the stand 40, a device is provided which includes an angled ramp completely therearound. Although the tee 10 is specifically designed so that the recess 19 thereof is immediately adjacent the rearmost surfaces of the tee 10, as described above in the summary of the invention, some kickers need the psychological boost which is provided through the use of ramp surfaces leading up to the location on the tee where the ball is to be kicked. Thus, the removable stand 40 provides this psychological boost for those kickers who need it and those kickers who do not need this psychological boost do not need to use the stand 40.

With further reference to FIG. 3, the stand 40 may be provided with an accessory enabling the tee to be elevated to a different elevation as desired. Thus, as shown in FIG. 3, an extension 47 may be provided having projections 49 which may be snapped into engagement with holes 51 formed in bottom surfaces of the stand 40. Thus, with the extension 47 so attached to the stand 40, the tee 10 will be elevated to whatever elevation is desired.

Figure 16:
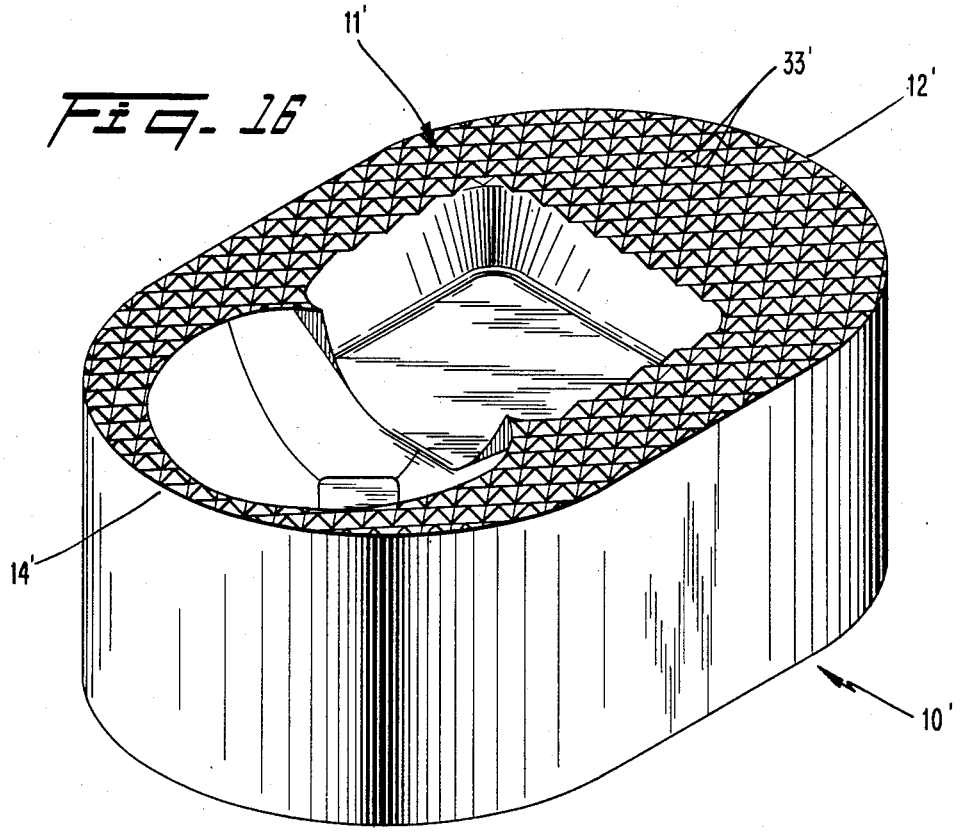
FIG. 16 shows a perspective view of a modified version of the tee of FIGS. 1, 2 and 15.

With further reference to FIG. 3, it is noted that due to the perpendicular nature of the side surfaces 17 of the tee 10 with respect to the top and bottom surfaces 11, 13 thereon, the tee 10 may be inserted into the stand 40 with either the top surface 11 facing upwardly or the bottom surface 13 facing upwardly. Thus, the stand 40 may be utilized with the tee 10 in either the kick-off mode or the kicking block mode. It is further noted that the stand 40 may be made so as to be usable in conjunction with tees 10 made of any thickness. For example, if the tee were to be made 2" thick, as depicted in FIG. 16 by the tee 10', the stand 40 would then be made so as to resemble the combination of the stand 40 and the extension 47 as shown in FIG. 3 with the peripheral lip 45 then being formed extending inwardly from the bottom surface 53 shown on the extension 47 in FIG. 3. As such, it should be understood that the extension 40 may take the form shown in FIG. 3, or it may include a removable extension 47, or it may be formed as a one-piece construction having the configuration of the combined stand 40 and extension 47 as shown in FIG. 3. Of course, if the stand 40 is to be utilized to elevate a tee made as the tee 10 is made as shown in FIG. 3, the stand 40 may be made as a one-piece construction encompassing all of the structure of the stand 40 and the extension 47 as shown in FIG. 3 with the lip 45 formed in the position shown therein.

Figure 4:
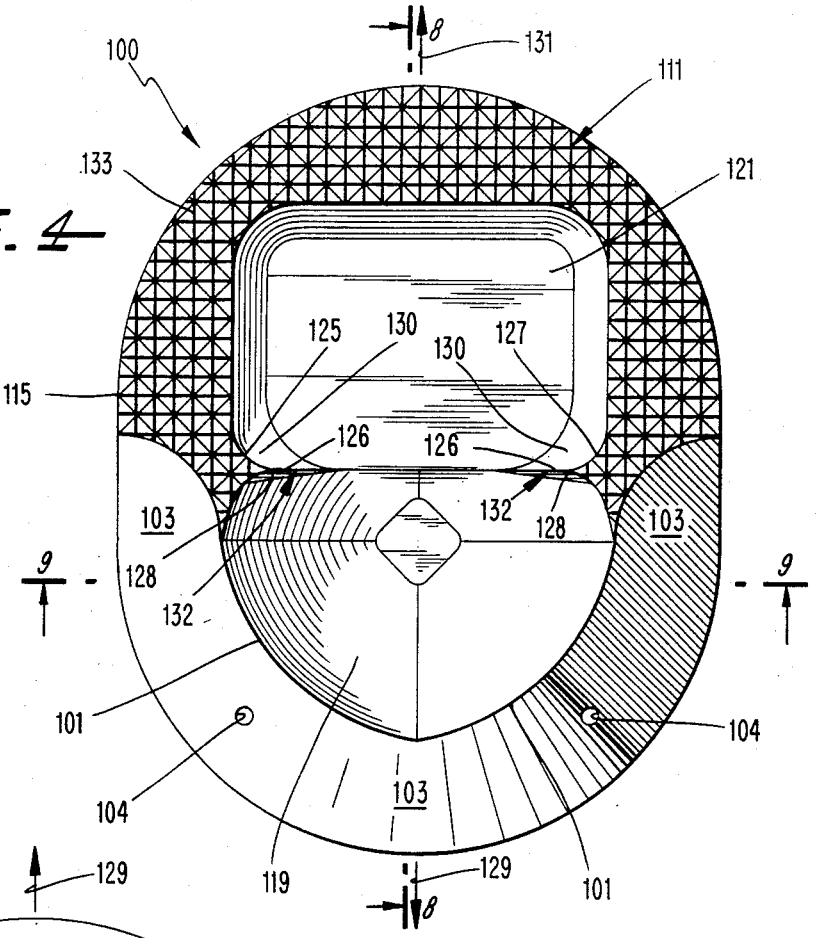
FIG. 4 shows a top view of a second embodiment of the present invention.
Figure 5:
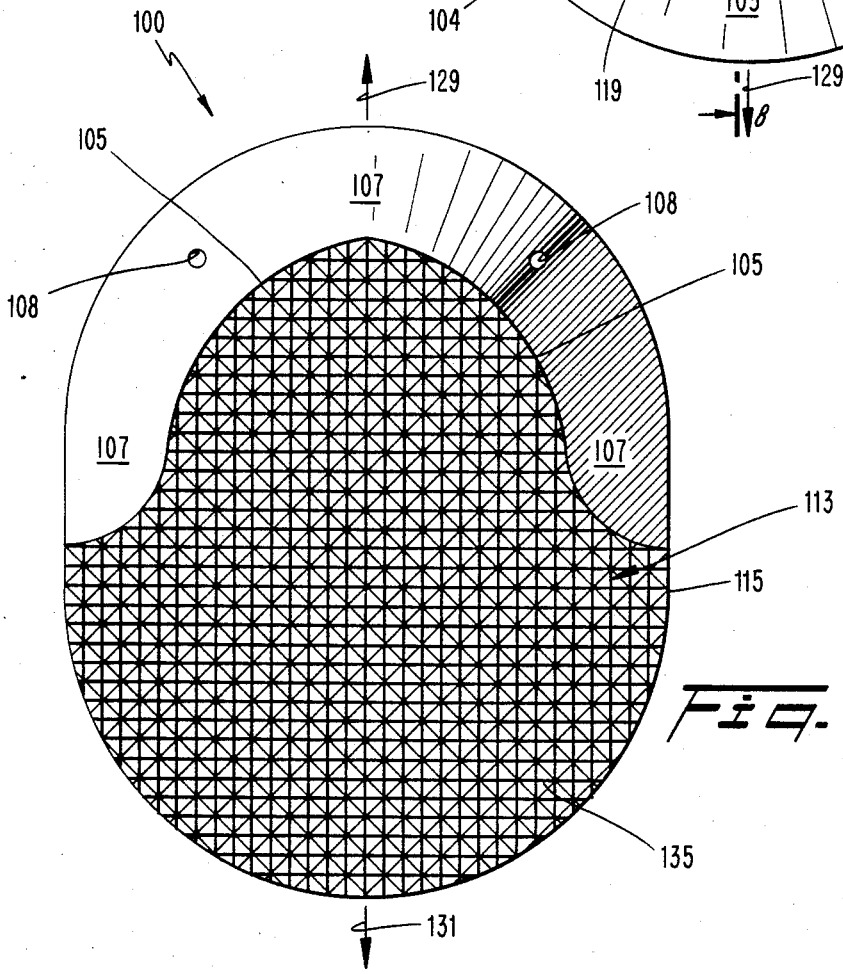
FIG. 5 shows a bottom view of the second embodiment of the present invention.

With reference now to FIGS. 4–9, a second kicking tee embodiment designated by the reference numeral 100 is shown. As seen in FIGS. 4 and 5, the tee 100 includes a top surface 111, a bottom surface 113, and a periphery 115 which defines a sidewall 117 as better seen with reference to FIGS. 6–9. With reference to FIG. 4, it is seen that the top surface 111 includes a first ball receiving recess 119 extending inwardly therefrom, a second recess 121 provided to allow the ball to be kicked therefrom, and a pair of opposed ribs 125 and 127 which are provided so as to enhance the retention of the football within the recess 119. The surface 111 includes a plurality of projections 133 identical to the projections 33 shown in FIG. 1 while the bottom surface 113 includes a plurality of projections 135 identical to the projections 35 shown in FIG. 2.

With reference back to FIG. 4, it is seen that the back edges 101 of the recess 119 are surrounded by an angled ramp surface 103 better seen with reference to FIGS. 6–9. In a similar fashion, the bottom surface 113 includes back surfaces 105 which are surrounded by an angled ramp 107 identical to the angled ramp 103. This is better seen with reference to FIGS. 6 and 8. The angled ramp surfaces 103 and 107 are provided in this embodiment so as to give the kicker a ramp up to the location where the ball is held by the tee 100. Thus, the embodiment of FIGS. 4–9 includes structure integrally formed therewith which overcomes the psychological problems which are overcome in the embodiment of FIGS. 1–3 through the use of the stand 40.

Figure 6:
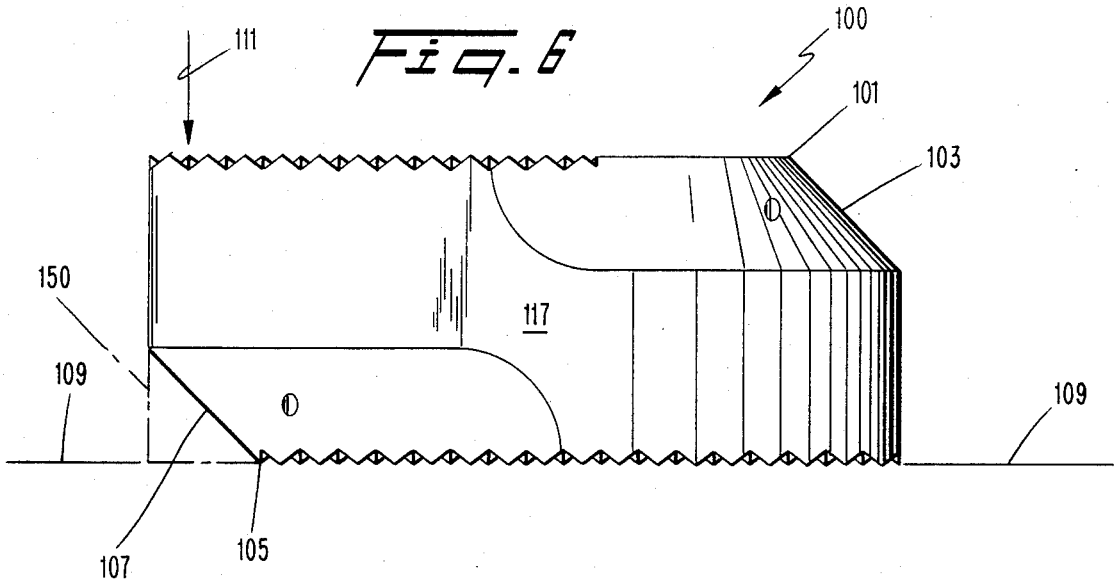
FIG. 6 shows a side view of the second embodiment of the present invention.
Figure 7:
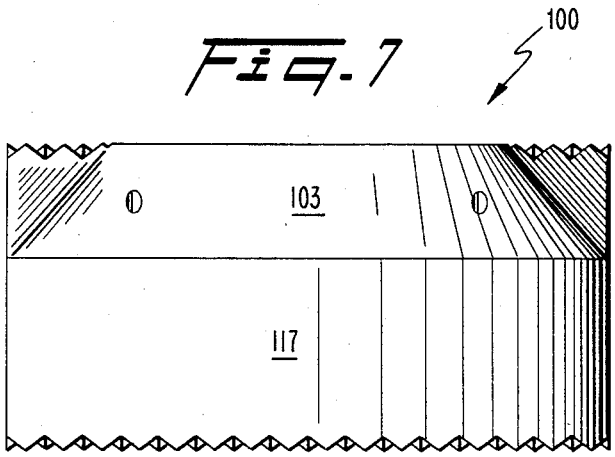
FIG. 7 shows an end view of the second embodiment of the present invention.
Figure 10:
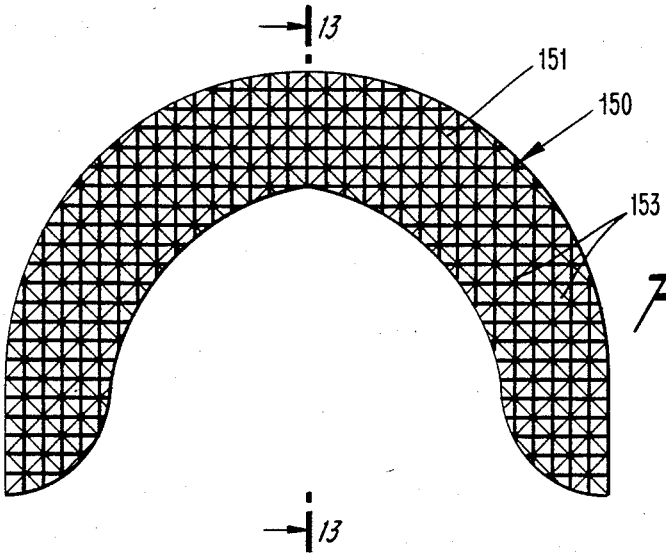
FIG. 10 shows a top view of an appliance removably attachable to the embodiment shown in FIGS. 4–9.

With reference to FIGS. 6 and 8, it is seen, for example, that when the tee 100 is placed in an orientation such that the surface 107 is facing the ground 109, an instability is introduced into the tee 100 such that a force applied to the tee 100 at the arrow 111 might cause the tee 100 to tip over thereby disrupting the kick. This problem has been solved in a unique way as will best be described through reference to FIGS. 4–7 and 10–13.

With reference first to FIG. 4, it is seen that the surface 103 includes a pair of holes 104 therein and with reference to FIG. 5, it is seen that the surface 107 includes a pair of holes 108 therein. The holes 104 and 108 are respectively identically situated with respect to the respective surfaces 103 and 107 and are provided for a purpose to be described with reference to FIGS. 10–13. In order to provide stability to the tee in any orientation thereof and to thereby solve the problems explained hereinabove with reference to FIGS. 6 and 8, an attachment piece 150 has been provided, which includes a substantially flat surface 151 having a plurality of projections 153 thereon identical to the projections 133 and 135 shown in FIGS. 4 and 5. The attachment piece 150 further includes with reference to FIGS. 11 and 13, a surface 155 having a pair of posts 157 extending outwardly therefrom. The posts 157 are located and configured so that they may be inserted into either the holes 104 or the holes 108 when the attachment piece 150 is assembled to the tee 100. When the attachment piece 150 is so assembled, the surface 155 thereof, is designed and configured so as to engage either the surface 103 or the surface 107 throughout. Thus, the surface 155 is designed so as to conform to the surfaces 103 and 107. As seen with reference to FIGS. 12 and 13, the attachment piece further includes an outer peripheral surface 159 which is designed to be parallel with the surface 117 of the tee 100 throughout. Thus, with reference to FIG. 6, when the tee 100 is placed in the orientation shown in FIG. 6, the attachment piece 150 may be attached so as to overlie the surface 107 of the tee 100 so that any forces on the tee as designated by the arrow 111 will have no effect upon the stability of the tee. In this regard, it is noted that since the surfaces 103 and 107 are identical to one another as are the respective locations of the holes 104 and 108, only one attachment piece 150 is needed for the tee 100, since the attachment piece 150 will only be applied to that surface, either 103 or 107, which would be facing the ground surface 109 in the particular orientation of the tee 100 that is chosen. It is noted that the posts 157 and holes 104, 108 are formed substantially parallel to the surfaces 117 of the tee so that the attachment piece 150 may easily be installed through reciprocation of the posts 157 into either the holes 104 or the holes 108.

In the prior co-pending application Ser. No. 629,429, in FIGS. 20–22 thereof, ribs 417 were disclosed as resiliently engaging surfaces of the football in a manner so as to resiliently bias the football in the direction of the arrow 420 so as to enable the surfaces 409 of the recess 407 thereof to snugly receive the end of the football therein. Through experimentation with the tee disclosed in FIGS. 20–22 of the above referenced application, it was discovered that when a football was placed in the recess, virtually no movement of the ribs 417 would take place. Rather, the edges of the ribs best seen in FIG. 22 of the above referenced pending U.S. patent application would dig into the surfaces of the football thereby resiliently biasing the surfaces of the football inwardly to thereby cause the football to be resiliently biased in the direction of the arrow 420 seen in FIG. 20 thereof. Thus, a problem arose in that the surface area of engagement of the ribs 417 was quite small being restricted solely to the innermost edges thereof. A further problem arose in that footballs made by different companies have slightly different tip configurations and, thus, the ribs 417 as disclosed in the above referenced pending U.S. patent application, were not as effective for some football brands as for other football brands. Further, as a football ages through the use thereof, the tip thereof begins to increase in dimensions thereby changing the manner of the football's fit into the recess. Thus, a new rib design was needed to enable the ball receiving recess to be adaptable to footballs made by different companies as well as to footballs at different stages along the aging process thereof.

The present invention includes structure incorporated therein which overcomes all of the problems inherent in the ribs 417 as disclosed in the prior above referenced U.S. patent application.

In this light, reference is made to FIGS. 1, 4, and 9. First, with reference to FIG. 1, it is seen that each of the ribs 25 and 27 is comprised of an inner end surface 26, a surface 28 facing the ball receiving recess 19, and a surface 30 facing the recess 21. Similarly, as shown in FIG. 4, the ribs 125 and 127 each have corresponding surfaces 126, 128 and 130. As may be seen with reference to FIGS. 1 and 4, the innermost portions of the ribs 25 and 27, designated by the reference numerals 32 and defined by the surfaces 28 and 30, are extremely thin and flexible in nature. Similar portions 132 are seen in FIG. 4. Thus, when a football is placed into the recess 19 or 119, the ribs do not protrude into the football as was the case with the ribs 417 disclosed in the above referenced pending patent application. Rather, the ribs flex in the direction of the arrows 31 or 131 so that the surfaces 28 or 128 thereof especially in the regions of the innermost portions 32 or 132 resiliently engage the outer surfaces of the football along a relatively large surface area, thereby resiliently engaging the outer surfaces of the football and urging the football in the direction of either the arrow 29 or the arrow 129. Then, when the football is kicked, the resiliency of the portions 32 or 132 of the ribs is sufficient so as to enable the ball to be kicked from the recess 19 or 119 with virtually no resistance thereto. Thus, the configuration and structure of the ribs of the kicking tees disclosed herein is vastly different and vastly improved over the structure and function of the ribs disclosed in the above referenced prior pending patent application since the line contact of engagement of the ribs 417 of the prior patent application with the football has been changed to a surface contact better facilitating the retention of the football therein while at the same time better facilitating the kicking of the football from the recesses thereof due to the added resiliency of the ribs. Thus, the ribs as disclosed herein are a much more effective means of retaining the football within the football recieiving recess than were the ribs as disclosed in the prior pending patent application.

In the prior application, several materials were disclosed as being usable in manufacturing the tees disclosed therein. The same materials are equally suitable for use in manufacturing the tees disclosed herein. Thus, the tees 10 and 100 may be made of such materials as polyurethane, polyvinylchloride, natural rubber and synthetic rubber, ethylenepropyleneturpolymer, foamed polyurethane, or reclaimed rubber which may be made from old, used tires and the like. Reclaimed rubber is a preferred material for the manufacture of the tees disclosed hereinabove due to its low cost and easy availability. However, one limitation of reclaimed rubber is the fact that tees made therefrom may only be made in the color black. Thus, if it is desired to make tees of colors other than black, natural or synthetic rubbers would be equally effective.

In the design of the tees disclosed herein, one factor which has been taken into account is the rigidity of the tee structure. Thus, after careful experimentation, it has been concluded that the tees of the present invention should be made of a hardness corresponding to 55–75 on the Shore A hardness scale. With the tees being made within these limits, sufficient rigidity is retained in the tee structure while sufficient resiliency in the ribs thereof is provided.

Regarding the stand 40 and extension 47 described hereinabove with reference to FIGS. 1–3, in the preferred embodiments thereof, they may be made of any lightweight vacuum formed or injection molded plastic material such as for example, polyethylene. The material and method chosen are chosen mainly based upon reasons of economy since the stand 40 and extension 47 do not need to possess the structural strength of the tee 10.

One further aspect of the present invention is shown with reference to FIG. 1. As shown in FIG. 1, the lines A and B may be drawn from the center of the diamond-like bottom 22 of the recess 19 outwardly from the recess 19 so that they subtend an angle defined by the arc C. The lines A and B intersect the periphery 15 of the tee 10 at the points D and E. The distance between the points D and E generally defines the width of the surface on the football at its rearward portion where the kicker will strike the football for an optimal kick. Thus, it is seen that when a football is placed into the recess 19 the surfaces of the football which are to be kicked by the kicker are suspended immediately behind and/or to the side of the surface F of the top surface 11 of the tee which lies immediately behind the recess 19. As may be seen in FIG. 1, the surface F is extremely thin between the periphery 15 of the tee and the recess 19, thus, it may be said that the recess 19 in the tee shown in FIG. 1 is immediately adjacent the rearwardmost portions of the kicking tee as defined by the periphery 15.

In a further aspect of the invention, reference is made to FIG. 9. As shown in FIG. 9, the ribs 125 and 127 include points designated by reference numerals 134 which face one another at the level of the surface 111 of the tee 100. These points 134 are separated from one another by the distance "X". The ribs for example 125, 127 of the present invention are located at the identical position around the non-circular circumference of the ball-receiving recess as are the ribs 417 of the prior application but due to their elongation, as described above, the distance X is smaller than the corresponding spacing in the ribs 417 of the prior application. The ends of the ribs 417 thereof nearest the top surface of the tee 400 were spaced from one another by about 2.2". Careful experimentation has led to the conclusion that elongation of the ribs of the present application so that the spacing X is within the range of about 1.8" to 2.0" results in the superior results explained hereinabove. Further, at the lowermost portions of the ribs 125 and 127, the end surfaces 126 thereof curve inwardly at 126' so that the lowermost portions of the ribs 125 and 127 are much closer to one another than are the corresponding lowermost portions of the ribs 417 of the above referenced pending U.S. patent application best seen in FIG. 22. The portions 128' of the surfaces 28 of the ribs 125, 127 which are formed by the curved portions 126' are provided for a specific purpose. In particular, these surfaces 128 allow the absolute end of the tip of the football to be supported thereon when the football is tilted rearwardly at an angle from vertical. Thus, the surfaces 128' improve the stability of the ball when placed in the tee at an angle departing from vertical, thereby improving tee performance.

In a further aspect of the present invention, the identical nature of the respective projections 33, 35 and 133, 135 of the respective tees 10 and 100 and thereby of the recesses between the projections, which recesses take the form of inverted pyramids in the preferred embodiment renders the surfaces of adjacent distinct tees interengageable in an intermeshing fashion. Thus, the tees of the present invention may be stacked in a quite stable manner so that a plurality of tees may be stacked to arrive at a composite tee structure, usable in the kicking tee or kicking block modes, of any desired thickness and height.

Thus, an invention has been disclosed hereinabove in terms of more than one embodiment, which invention comprises a kicking tee vastly improved over prior art designs. It is submitted here that various changes, modifications and alterations from the structure and function disclosed herein may be apparent to those skilled in the art and such changes, modifications and alterations may be made without departing from the intended scope of the invention disclosed herein. Accordingly, it is intended that the invention as described hereinabove be only limited by the scope of the following claims.

I claim:

1. In an improved football kicking tee including:

(a) a base portion including a first substantially flat surface and a second surface spaced from said first surface;

(b) a recessed portion of predetermined depth in said second surface extending toward said first surface and (c) said recessed portion being at least partially shaped in general conformance with the shape of the end of an oblate spheroidal football whereby said recess portion is adapted to engage and support said football therein while providing substantially no resistance to kicking of said football out of said recessed portion; the improvement comprising:

(d) said base portion having a front face and a rear face defining the rearmost extend of said tee; and (e) said recessed portion including a rear profile at an intersection of said recessed portion and said second surface, said rear profile generally corresponding in configuration to a surface of said football, said base portion rear face intersecting with said second surface in a curved profile closely adjacent to said rear profile whereby when said football is inserted into said recessed portion substantially all surfaces of said football above said tee and facing away from said front face and below a middle portion of said football are located on a side of said curved profile remote from said recessed portion, said recessed portion including an opening of approximately said predetermined depth remote from said rear profile and means associated with said opening for aiding in retaining said football in said recessed portion.

2. In an improved football kicking tee including:

(a) a base portion including a first substantially flat surface and a second surface spaced from said first surface;

(b) a recessed portion of predetermined depth in said second surface extending toward said first surface; and (c) said recessed portion being at least partially shaped in general conformance with the shape of the end of an oblate spheroidal football whereby said recessed portion is adapted to engage and support said football therein while providing substantially no resistance to kicking of said football out of said recessed portion; the improvement comprising;

(d) said base portion having a front face and a rear face defining the rearmost extent of said tee; and (e) said recessed portion including a rear profile at an intersection of said recessed portion and said second surface, said rear profile generally corresponding in configuration to a surface of said football, said base portion rear face intersecting with said second surface in a curved profile closely adjacent to said rear profile whereby when said football is inserted into said recessed portion the arc of a placekicker's foot in a kicking motion thereof to kick said football, regardless of the kicking style, will not intersect with any structure of said tee, said recessed portion including an opening of approximately said predetermined depth remote from said rear profile and means associated with said opening for aiding in retaining said football in said recessed portion.

3. The invention of claim 1 or 2, wherein said second surface is substantially flat and substantially parallel with said first surface, whereby with said first surface facing and engaging a ground surface, said tee comprises a placekicking tee and with said second surface facing and engaging said ground surface, said tee comprises a placekicking block.

4. The invention of claim 3, wherein said first surface and second surface are covered with small projections whereby each of said surfaces may grip said ground surface, and with said second surface facing and engaging said ground surface, said projections on said first surface may grip said end of said football.

5. The invention of claim 4, wherein said projections covering said first surface and second surface are all identical and define projection recesses therebetween, whereby a plurality of tees may be stacked through interengagement of facing projections and projection recesses, whereby a composite tee of any desired thickness may be created.

6. The invention of claim 3, wherein said base portion includes a peripheral surface, and further comprising a skirt removably attached to said base portion in engagement with said peripheral surface, said skirt including inclined surfaces forming a ramp at least at a region thereon behind said curved profile.

7. The invention of claim 6, wherein said peripheral surface is substantially perpendicular to said base portion first surface whereby said skirt may be attached to said tee with said first surface facing toward or away from a ground surface, whereby said skirt may be utilized with said tee when said tee is being used as either a placekicking tee or a placekicking block.

8. The invention of claim 1 or 2, wherein said recessed portion includes first recess surface means shaped in general conformance with the shape of the end of said football and said means associated comprises second recess surface means defining said opening adapted to resiliently engage said football end.

9. The invention of claim 4, wherein said second recess surface means comprises a pair of opposed ribs protruding inwardly from said first recess surface means.

10. The invention of claim 9, wherein each said rib includes a first rib surface facing said rear profile and a second rib surface facing said front face, said first and second rib surfaces intersecting at an end surface, said ribs being elongated toward one another so that each rib is thin and flexible at and immediately adjacent said rib end surface whereby when said football end is inserted into said first recess surface means, said ribs resiliently flex toward said base portion front face and said first rib surfaces engage surfaces of said football facing said base portion front face in a surface contact therewith, the resiliency of said ribs biasing said football end into firm engagement with said first recess surface means.

11. The invention of claim 10, wherein said rib end surfaces include first ends at said base portion second surface and second ends remote therefrom, said rib end surface first ends being separated from one another by a distance greater than the distance of separation of said rib end surface second ends, said rib end surfaces each being of a curved configuration at at least those portions thereof adjacent said rib end surface second ends.

12. The invention of claim 11, whereby said rib end surface first ends are separated from one another by a distance less than 2".

13. The invention of claim 9, wherein said recessed portion includes a relieved portion adjacent said ribs, said ribs defining therebetween a first space connecting said relieved portion with a second space bounded by said first recess surface means, said relieved portion enabling said football to be kicked out of said recessed portion with substantially no resistance, said first space including said opening.

14. The invention of claim 1 or 2, wherein said rear face includes a tapered surface extending from said curved profile at least a portion of the distance toward said first of said base portion.

15. The invention of claim 14, wherein said base portion front face, intersects with said first surface at a further curved profile, said base portion front face including a further tapered surface extending from said further curved profile at least a portion of the distance to base portion second surface.

16. The invention of claim 15, wherein said tapered surface and said further tapered surface are substantially identical in configuration, said tee further including a detachable piece having an inner surface corresponding to said tapered surface and a further tapered surface, an outer surface corresponding to said base portion front face and rear face and a flat surface corresponding to said base portion first surface and second surface, said detachable piece being selectably attachable in overlying engagement with either said tapered surface or said further tapered surface.

17. The invention of claim 16, wherein said base portion first surface and second surface and said detachable piece flat surface each have a plurality of projections extending outwardly therefrom.

18. The invention of claim 16, wherein said tapered surface and further tapered surface each has a hole therein, said detachable piece inner surface having a post extending outwardly therefrom, said detachable piece being assembled to said tee by insertion of said post into one of said holes.

19. In an improved football kicking tee including:

(a) a base portion including a first substantially flat surface and a second surface spaced from said first surface;

(b) a recessed portion of predetermined depth in said second surface extending toward said first surface; and (c) said recessed portion being at least partially shaped in general conformance with the shape of the end of an oblate spheroidal football whereby said recessed portion is adapted to engage and support said football therein while providing substantially no resistance to kicking of said football out of said recessed portion; the improvement comprising:

(d) said base portion having a front face and a rear face defining the rearmost extent of said tee; and (e) said recessed portion including a rear profile at an intersection of said recessed portion and said second surface, said rear profile generally corresponding in configuration to a surface of a football, said base portion rear face intersecting with said second surface in a curved profile closely adjacent to said rear profile, said recessed portion including an opening of approximately said predetermined depth remote from said rear profile and means associated with said opening for aiding in retaining said football in said recessed portion.

20. The invention of claim 19, further comprising a skirt removably attached to said base portion, said skirt including inclined surfaces forming a ramp at least at a region thereon behind said curved profile.

21. The invention of claim 20, wherein said skirt includes a skirt recess therein, said base portion being removably attached to said skirt by inserting said tee into said skirt recess.

22. The invention of claim 21, wherein said base portion includes peripheral surfaces which engage further peripheral surfaces in said skirt recess when said tee is inserted therein.

23. The invention of claim 22, wherein said base portion peripheral surfaces are substantially perpendicular to said base portion first surface whereby said tee may be inserted in said skirt recess with said first surface facing toward or away from a ground surface.

24. The invention of claim 21, wherein said skirt recess has a bottom surface spaced from a lowest extent of said skirt, whereby said skirt elevates a tee inserted into said skirt recess.

* * * * *